US006013144A

United States Patent [19]

Callaway

[11] Patent Number: 6,013,144

[45] Date of Patent: Jan. 11, 2000

[54] PYROTECHNIC MATERIAL

[75] Inventor: James Callaway, Farnborough, United Kingdom

[73] Assignees: Secretary of State for Defence in her Britannic Majesty's Government of the United Kingdom of Great Britain; North Ireland of Defence Evaluation and Research Agency, both of United Kingdom

[21] Appl. No.: 08/930,893

[22] PCT Filed: Apr. 12, 1996

[86] PCT No.: PCT/GB96/00886

§ 371 Date: Oct. 14, 1997

§ 102(e) Date: Oct. 14, 1997

[87] PCT Pub. No.: WO96/33144

PCT Pub. Date: Oct. 24, 1996

[30] Foreign Application Priority Data

Apr. 18, 1995 [GB] United Kingdom ..... 9507829

[51] Int. Cl.[7] ..... C06B 33/00

[52] U.S. Cl. ..... 149/108.2; 149/37; 428/113; 102/336

[58] Field of Search ..... 149/37, 108.2; 428/113; 102/336

[56] References Cited

U.S. PATENT DOCUMENTS

| | | | |
|---|---|---|---|
| 3,259,532 | 7/1966 | Reynolds | 149/108.2 |
| 4,756,778 | 7/1988 | Peitz et al. | 149/108.2 |
| 4,794,059 | 12/1988 | Hope | 429/192 |
| 4,880,483 | 11/1989 | Baldi | 149/108.2 |
| 5,547,525 | 8/1996 | Bennett et al. | 149/108.2 X |
| 5,656,794 | 8/1997 | Krone et al. | 149/108.2 |
| 5,679,921 | 10/1997 | Hahn et al. | 149/108.2 X |
| 5,682,014 | 10/1997 | Highsmith et al. | 149/36 |

FOREIGN PATENT DOCUMENTS

| | | |
|---|---|---|
| 2 346 634 | 10/1977 | France . |
| 2 282 389 | 4/1995 | United Kingdom . |
| 2 283 303 | 5/1995 | United Kingdom . |
| WO A 87 07888 | 12/1987 | WIPO . |

*Primary Examiner*—Peter A. Nelson
*Attorney, Agent, or Firm*—Nixon & Vanderhye

[57] ABSTRACT

An infrared emitting pyrotechnic material comprising a fibrous carbon containing substrate (1) onto one or both faces (4, 5) of which is vapor deposited a combustible material layer (2, 3) which may be protected by an additional coating (6, 7). The thickness and composition of each of the layers (2, 3) are selected such that in use each of the layers is capable of igniting substantially simultaneously the entire surface on which it is deposited.

15 Claims, 2 Drawing Sheets

PYROTECHNIC MATERIAL

The present invention relates to a pyrotechnic material and in particular to a pyrotechnic material suitable for use as an infra red (IR) radiation source.

Known material, such as that disclosed in U.S. Pat. No. 4,624,186, comprises thin supports, for example metal foil or paper, on to which is pressed an incendiary paste to form IR emitting flakes. The incendiary paste is constituted with more or less incendiary material in order to speed up or slow down its burn rate and hence control the IR emission characteristics of the flakes. Here it is the paste which, in the main, acts as the IR radiation source. This has the disadvantage that because the pressing process used to coat the thin supports is not accurately controllable the IR emission characteristics of the material so produced is not accurately controllable or reproducible.

It is an aim of the present invention to provide a pyrotechnic material suitable for use as an IR emitter having controllable and reproducible IR emission characteristics.

According to the present invention there is provided a pyrotechnic material characterised in that a fibrous, carbon containing substrate has vapour deposited on substantially all of the surface of one or both faces thereof a combustible material layer, the layer being capable in use of igniting substantially simultaneously the entire surface on which it is deposited.

In use this flash ignition of the surface of the carbon containing substrate by the combustible layer exposes a burning surface of the substrate which then continues to burn to act as a IR radiation source.

The duration of burning of the substrate and hence the emission characteristics, such as wavelength and intensity distributions, of the IR radiation can be controlled to some extent by regulating the carbon content of the substrate. Clearly it is essential that the substrate of the current invention remains for a period of time after the consumption of the combustible layer and it has been found that in order to achieve this the carbon content of the substrate must lie in the range of between 20 $g/m^2$ and 400 $g/m^2$ and should preferably lie in the range of between 50 $g/m^2$ and 150 $g/m^2$. Suitable substrates may comprise a consolidated layer of fibres, for example as in a felt or a woven carbon cloth such as a carbonised rayon textile. Moreover the high degree of control over the physical characteristics of the combustible layer offered by vapour deposition enables the emission properties of the pyrotechnic material to be reliably reproduced.

A further advantage of vapour deposition is that the combustible material layer is deposited directly onto individual, exposed fibres of the substrate which contain, or are covered with, carbon. This maximises the intermingling of the carbon content of the substrate and the combustible material layer at the interface to provide a large, intimate contact area between the two. The resulting pyrotechnic material exhibits considerable resistance to spontaneous ignition but, largely because of this intimate contact, the controlled ignition of the combustible layer at any selected location spreads substantially simultaneously across the entire layer. Intimate interfacial contact, and consequentially the ignition transfer through the combustible layer, is further enhanced by the nature of vapour deposition processes which are conventionally conducted in essentially oxygen-free environments such as a vacuum or a low pressure inert atmosphere, so preventing any inhibiting film of oxide which may form between the combustible material layer and the carbon containing substrate. Furthermore, vapour deposition ensures that the advantageous properties of the textile type substrate base material (such as flexibility, strength, and toughness) are not substantially degraded during the manufacture of the pyrotechnic product.

The thickness and composition of the combustible material layer is selected to ensure reliable and rapid progression of the ignition through the combustible material layer and to generate sufficient energy to establish combustion of the substrate surface. If the layer is too thick then excessive heat conduction from the interface into the combustible material layer itself may occur and consequently the reaction may self progress too slowly to provide the required rapid ignition of the substrate. Whereas if too thin then insufficient heat will be generated by the combustion of the layer to ignite the substrate. For these reasons the combustible material layer thickness deposited on one or both faces of the substrate should be between 5 microns and 200 microns per face and most preferably between 20 microns and 80 microns per face. Since the substrate is both porous and compressible then measurement of the thickness of any layer actually deposited onto the substrate may be inaccurate. The layer thicknesses quoted herein are therefore actually the thickness of layers contemporaneously deposited onto a non-porous reference substrate, for example an adhesive tape, placed within the deposition chamber proximal to the fibrous, carbon containing substrate.

Combustible metallic materials are particularly suitable for use as the combustible material layer since when deposited using a vapour deposition process the metallic materials form a highly porous layer. This porous layer provides a greatly enhanced surface area over which the oxidation reaction can occur and so facilitates the rapid spread of ignition through the combustible layer.

The combustible metallic layer may comprise a single metal, two or more metals deposited either as separate layers as an alloy or as an intermetallic or any combination of individual alloy/metal/intermetallic layers. Alternatively, thermite type multi-layers maybe used which comprise alternate layers of metal and metal oxide, the oxide being formed by regulating oxygen fed into the reaction chamber of a vapour deposition system, and may for example consist of alternating layers of aluminium and iron oxide.

Irrespective of how the metallic material combustible layer is constituted the selected metal is preferably one which reacts rapidly in air to generate sufficient heat when ignited to initiate the burning of the carbon containing substrate. Because of this and its ready availability, it is particularly preferred that the combustible layer comprises magnesium. The metallic material layer may comprise an alternative metal or an alloy thereof, particularly metals known to react vigorously with air, such as aluminium, boron, beryllium, calcium, strontium, barium, sodium, lithium and zirconium. A layer of magnesium or magnesium alloy of between 40 microns and 60 microns thick per face, is especially preferred, for example deposited on to one or both faces of a carbonised viscose rayon textile.

In order to extend the storage life of such a pyrotechnic material and to stabilise the ignition properties of the combustible material layer a protective layer may be deposited on top of the combustible material layer. This protective coating may suitably consist of a vapour deposited layer of a less reactive metal, for example titanium or aluminium (in cases where a more easily combustible metal is used, for example magnesium), of between 0.1 microns and 10 microns thick and preferably no more than 1 micron thick or may consist of a non-metallic coating deposited onto the combustible material layer using conventional spray or dip deposition techniques.

Most usefully the pyrotechnic material may additionally comprise an oxidant deposited onto the substrate. This oxidant provides a source of oxygen which is available to enhance the speed of ignition transfer through the combustible layer; to enable the substrate to continue to burn in conditions where the atmospheric oxygen is limited (for example if the material is used inside a closed container); and to control, to some extent, the burn time and hence the IR emission characteristics of the substrate.

Where the substrate comprises a consolidated layer of fibres, such as in a carbon cloth, which is able to absorb liquid then it is convenient to deposit the oxidant onto the substrate in solution. Suitable oxidants are water soluble inorganic salts such as metal nitrates, nitrites, chlorates and perchlorates. For example where carbon cloth is passed through a 5% w/w aqueous solution of potassium nitrate its burn time is increased but if passed through a 5% w/w aqueous solution of potassium phosphate its burn time is reduced.

It will be appreciated by those skilled in the art that an oxidant containing substrate may also be achieved using a suitable pre-treatment for the carbon containing textile, for example the introduction of lead acetate and copper during the carbonisation process of the substrate material leads to a fibrous activated carbon substrate having lead oxide as an oxidant, without the need to separately deposit an oxidant.

An embodiment of the pyrotechnic material according to the present invention together with a use for this material will now be described by way of example only with reference to the accompanying drawings in which.

Figure 1:
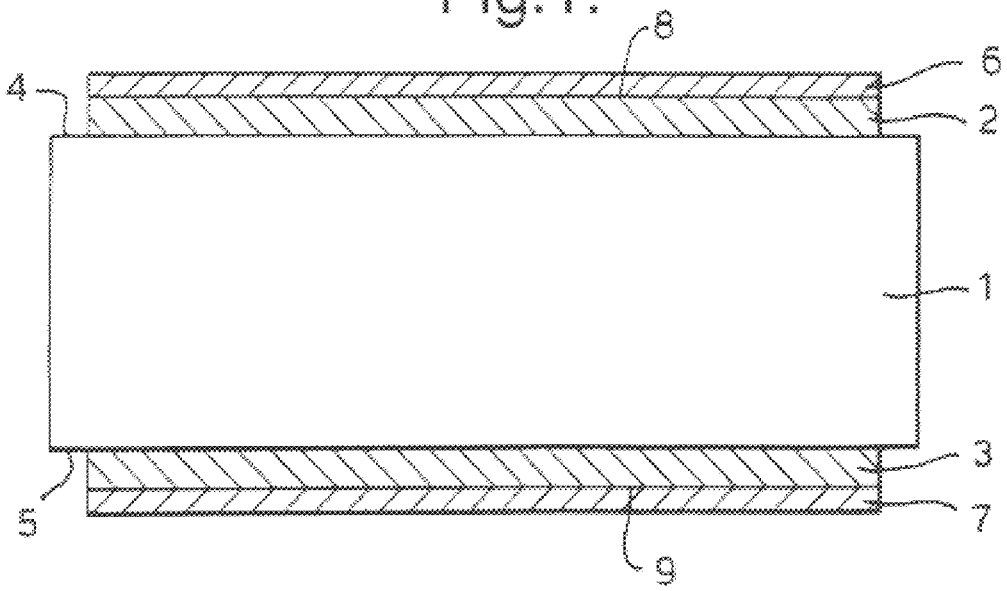
FIG. 1 shows a part sectioned view of the pyrotechnic material.

Referring now to FIG. 1, the pyrotechnic material consists of a carbonised viscose rayon substrate 1 having combustible layers 2,3 each consisting of approximately 40 microns thick magnesium, vapour deposited onto substantially all of the surface of the respective faces 4,5 thereof. Further layers 6,7 of titanium as a protective coat are vapour deposited to a thickness of approximately 0.5 microns onto the exposed surfaces 8,9 of the combustible layers 2,3.

The substrate 1 is formed from a 2.5 cm×10 cm×150 micron, 110 g/m$^2$ fibre containing viscose rayon tape. The tape is then carbonised in the presence of a copper salt activating agent and a potassium salt oxidant precursor at around 1200° C. using a conventional pyrolysis carbonisation process comprising four stages: precarbonisation, where physically adsorbed solvents, water or monomers are removed; carbonisation (between 300 and 500° C.), during which oxygen, nitrogen and halogens are removed and conjugation and crosslinking occurs between the carbon units; dehydrogenation (between 500 to 1200° C.), increasing the interconnection of the conjugated carbon; and annealing (above 1200° C.) where the material attains a more crystalline structure and defects are gradually removed. The substrate 1 so formed is highly porous and has lead oxide as an oxidant absorbed therein.

The layers 2,3,6,7 are deposited using conventional vacuum deposition equipment (not shown). The deposition source material may be located in a separate vaporising boat (not shown) and vaporised either by heating the boat or by scanning the surface of the deposition source with an electron beam in an inert atmosphere such as argon gas. Alternatively, the source may comprise a bar of material which is subjected to magnetron sputtering or inductive coil evaporation.

Figure 2:
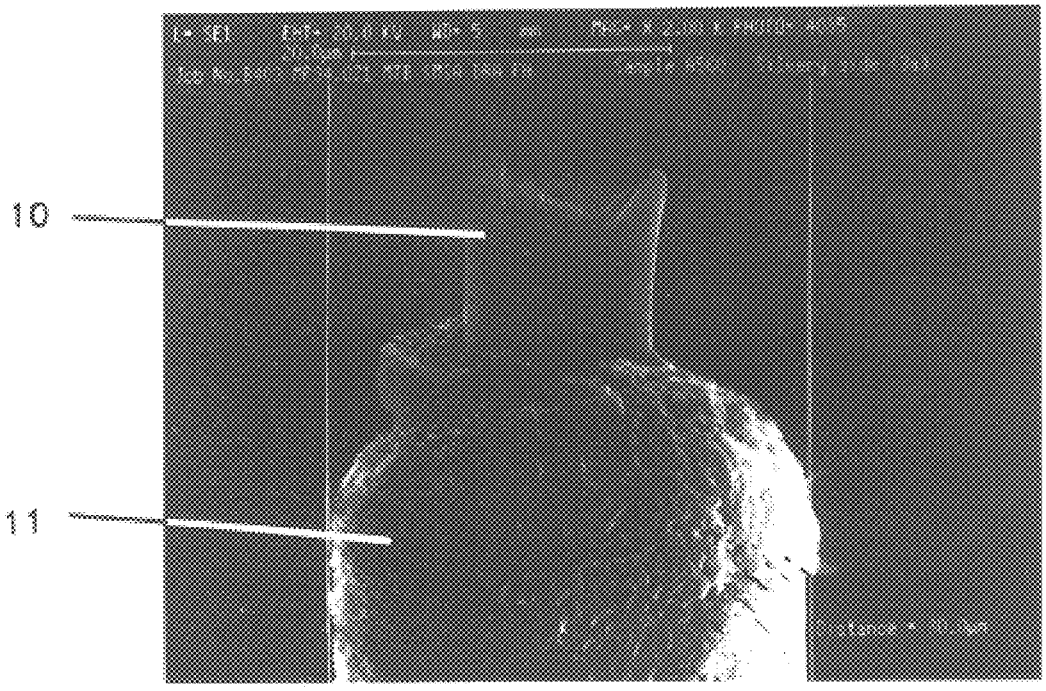
FIG. 2 shows an electron micrograph of an exposed carbon fibre of the pyrotechnic material of FIG. 1.

The magnesium is deposited directly onto the exposed surface of the substrate 1 to form the combustible material layers 2,3. FIG. 2 is an electron micrograph at ×2000 magnification showing an exposed carbonised fibre 10 at the surface of the substrate having a radial deposit 11 of 5 microns of magnesium.

The pyrotechnic material thus fabricated may be edge-trimmed prior to use to remove any uncoated substrate 1.

Figure 3:
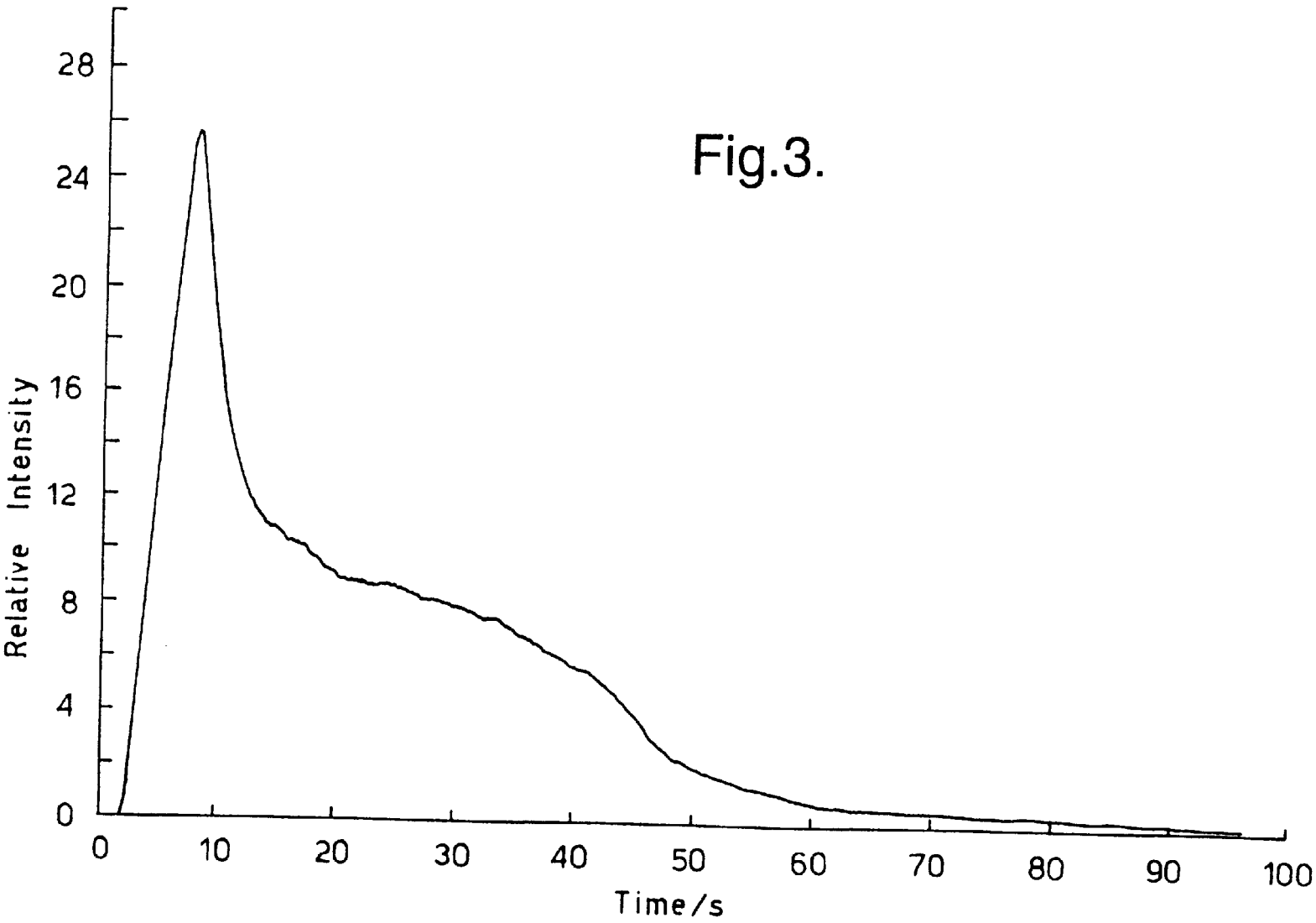
FIG. 3 shows the relative intensity variation in the total IR radiation output of the material of FIG. 1 with time.

The typical variation in the intensity of the total radiation emission of the material shown in FIG. 1 with time is represented in FIG. 3.

I claim:

1. A pyrotechnic material characterised in that a fibrous, carbon containing substrate has vapour deposited on substantially all of the surface of one or both faces thereof a combustible material layer, the layer being capable in use of igniting substantially simultaneously the entire surface on which it is deposited.

2. A pyrotechnic material as claimed in claim 1 characterised in that the carbon content of the substrate is between 20 g/m$^2$ and 400 g/m$^2$.

3. A pyrotechnic material as claimed in claim 2 characterised in that the carbon content of the substrate is between 50 g/m$^2$ and 150 g/m$^2$.

4. A pyrotechnic material as claimed in claim 1 characterised in that the substrate comprises a consolidated layer of fibres.

5. A pyrotechnic material as claimed in claim 4 characterised in that the substrate is formed from a woven carbon cloth.

6. A pyrotechnic material as claimed in claim 5 characterised in that the woven carbon cloth is a carbonised rayon textile.

7. A pyrotechnic material as claimed in claim 1 characterised in that combustible material layer is between 5 microns and 200 microns thick.

8. A pyrotechnic material as claimed in claim 7 characterised in that the combustible material layer is between 20 microns and 80 microns thick.

9. A pyrotechnic material as claimed in claim 1 characterised in that the combustible material layer comprises a combustible metallic material having metals selected from the group magnesium, aluminium, boron, beryllium, calcium, strontium, barium, sodium, lithium and zirconium.

10. A pyrotechnic material as claimed in claim 9 characterised in that the combustible layer comprises a layer of magnesium of between 40 microns and 60 microns thick.

11. A pyrotechnic material as claimed in claim 9 further comprising a layer of a less reactive metal vapour deposited onto the exposed surface of the combustible material layer.

12. A pyrotechnic material as claimed in claim 11 characterised in that the layer of a less reactive metal consists of a layer of titanium or aluminium of between 0.1 microns and 10 microns thick.

13. A pyrotechnic material as claimed in claim 11 characterised in that the thickness of the less reactive metal layer is no greater than 1 micron.

14. A pyrotechnic material as claimed in claim 1 characterised in that the material further comprises an oxidant deposited onto the substrate.

15. A pyrotechnic material as claimed in claim 14 characterised in that the oxidant is a water soluble inorganic salt.

* * * * *